United States Patent [19]

Heap

[11] 4,254,714

[45] Mar. 10, 1981

[54] DUAL BOTTOM TROUGH GONDOLA RAILWAY CAR

[75] Inventor: James C. Heap, Munster, Ind.

[73] Assignee: Thrall Car Manufacturing Company, Chicago Heights, Ill.

[21] Appl. No.: 826,341

[22] Filed: Aug. 22, 1977

[51] Int. Cl.[3] ..... B61D 3/00; B61D 7/00; B61D 17/10

[52] U.S. Cl. ..... 105/406 R; 105/364; 105/416; 105/419; 105/422

[58] Field of Search ..... 105/248, 282 R, 359, 105/360, 406 R, 416, 418, 419, 422, 364, 244

[56] References Cited

U.S. PATENT DOCUMENTS

| | | | |
|---|---|---|---|
| 719,868 | 2/1903 | Randel | 105/282 R X |
| 750,049 | 1/1904 | Carnahan | 105/406 R |
| 1,054,087 | 2/1913 | Campbell | 105/244 X |
| 1,069,763 | 8/1913 | Campbell | 105/244 X |
| 1,412,660 | 4/1922 | Kuehner | 105/282 R X |
| 1,531,761 | 3/1925 | Seiders | 105/406 R |
| 1,627,256 | 5/1927 | Smith | 105/282 R X |
| 3,127,851 | 4/1964 | Auksel | 105/248 |
| 3,175,520 | 3/1965 | Talmey | 105/419 X |
| 3,240,168 | 3/1966 | Charles et al. | 105/406 R |
| 3,713,400 | 1/1973 | Teoli | 105/422 |
| 3,918,370 | 11/1975 | Campbell et al. | 105/416 |

OTHER PUBLICATIONS

Carbuilder, Pulman Standard, Jan. 1977, Issue No. 1, Cover, XXXIX, 8, 9, and Rear Mailing Cover pp.

Progressive Railroading, Murphy-Richter Publishing Co., It's Called the "Coalporter", Front Cover; Contents, 5; 67; pp., Aug. 1977.

*Primary Examiner*—Howard Beltran

*Attorney, Agent, or Firm*—Merriam, Marshall & Bicknell

[57] ABSTRACT

A gondola railway car having a car truck attached to each end of a continuous center sill, a pair of generally vertical end panels, a pair of generally vertical side panels joined to the end panels, a plurality of cross bearers extending from the center sill to a longitudinal chord at the bottom of each side panel, a car bottom between the end and side panels having substantially flat portions over the trucks and a pair of longitudinal trough portions between the trucks and the flat bottom portions, each trough portion having a side edge joined to a side panel bottom edge and a side edge joined to the center sill, and an end wall at each end of each trough extending to the adjacent flat bottom portion.

9 Claims, 11 Drawing Figures

14
151
66
64
63
62
172
171
140
83
7
136
80
134
81
130
59
8
170
41
40
65
58
35
20
42
55
57
54
A
R'
181
160
R²
135
180
133
B
161
53
56
150
C
162
93
120
52
13
130
136
134
80
81
170
83

DUAL BOTTOM TROUGH GONDOLA RAILWAY CAR

This invention relates to railway cars and more particularly to a railway car of the open gondola type in which lading is loaded and unloaded from the open top.

Gondola railway cars are normally employed to carry bulky granular or lump materials such as coal, sand and gravel. Conventional gondola cars have a continuous center sill structure extending the length of the car and a flat floor on the top of the center sill supported by it and cross bearers. This leads to a high center of gravity in the loaded car.

Anthony Teoli in U.S. Pat. No. 3,713,400 discloses a gondola railway car which has a parabolic shaped bottom between the trucks and no continuous center sill. The center sill is replaced by stub center sills at each end and means for interconnecting the stub center sills with side sills for transferring longitudinal forces the length of the car. The car has no center sill from one stub sill to the other stub sill. The car is said to be light weight because of the use of an unreinforced parabolic bottom sheet and the elimination of the center sill and to have a low center of gravity when loaded.

A. F. Charles U.S. Pat. No. 3,240,168 discloses a gondola railway car much like that shown in the Teoli patent but with the dropped bottom between the trucks reinforced by spaced apart lateral ribs. The Charles car also lacks a center sill between the trucks.

Although the described prior art gondola cars have the advantage of a lower loaded center of gravity and lighter weight empty than a conventional gondola car they are relatively expensive to fabricate since special structures for transfer of longitudinal forces from the end stub sills to the side sills are required.

According to the present invention there is provided a gondola car of reduced weight, increased capacity and lower center of gravity when loaded than conventional gondola cars but which has a continuous center sill from end-to-end. More specifically, there is provided a gondola railway car having a car truck attached to each end of a continuous center sill, a pair of generally vertical end panels, a pair of generally vertical side panels joined to the end panels, a plurality of cross bearers extending between longitudinal chords at the bottom of each side panel, a car bottom between the end and side panels having substantially flat portions over the trucks and a pair of longitudinal trough portions between the trucks and the flat bottom portions, each trough portion having a side edge joined to a side panel bottom edge and a side edge joined to the center sill, and an end wall at each end of each trough extending to the adjacent flat bottom portion.

For a smooth joint the side edge portions of the trough join the side panels and the center sill in substantially the same plane. The top of the cross bearers is desirably made about the same height as, or slightly higher than, the top of the center sill. Desirably, at least one vertical web or plate is joined to a cross bearer and extends and is joined to the trough therebeneath and divides the trough into compartments to reinforce the trough. With the use of such a web or plate, each compartment can be left unsupported between its ends. Thus, each compartment need contain no internal bracing below the level of the cross bearers.

The trough is generally a smooth arc in lateral section. It may be semi-elliptical, parabolic, a circular cylindrical section, cantenary, one-half of a sine wave, one-half of a cosine wave, part of a logarithmic or equiangular spiral, a portion of a spiral of Archimedes, two circular cylindrical sections of different radii or a portion thereof or of another but related shape. It may also be a polygon section with equal or unequal sides made by pressing a flat plate in a press brake to form one or more creases to shape the polygon sides.

The invention will be described further in conjunction with the attached drawings, in which.

So far as is practical the same elements or parts which appear in the different views of the drawings will be identified by the same numbers.

Figure 1:
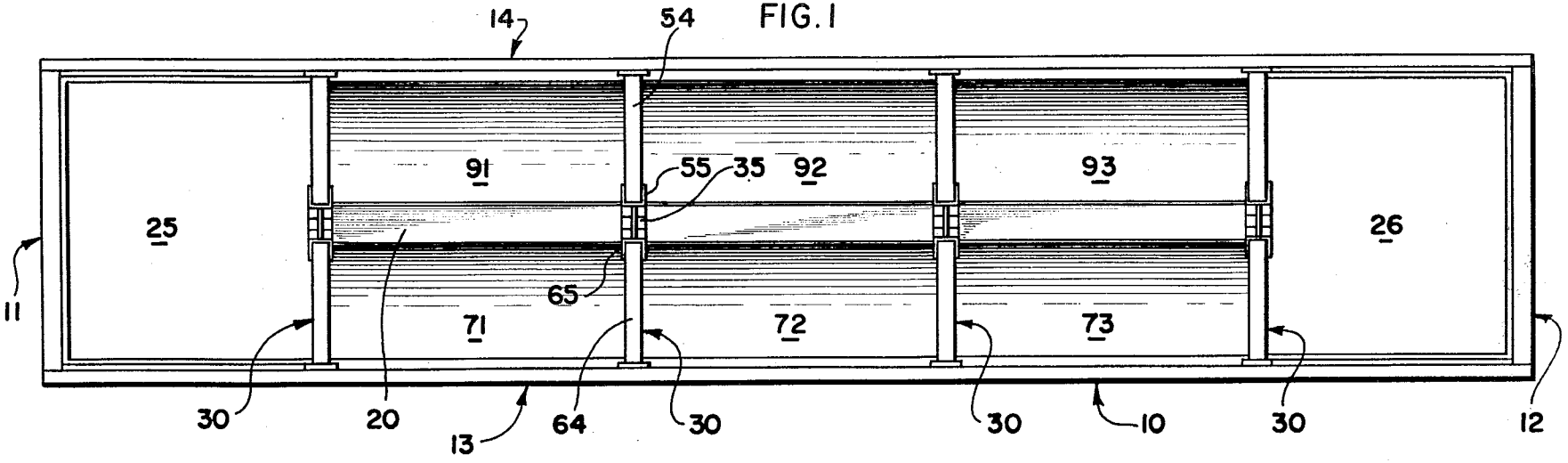
FIG. 1 is a plan view of a gondola railway car provided by the invention.
Figure 2:
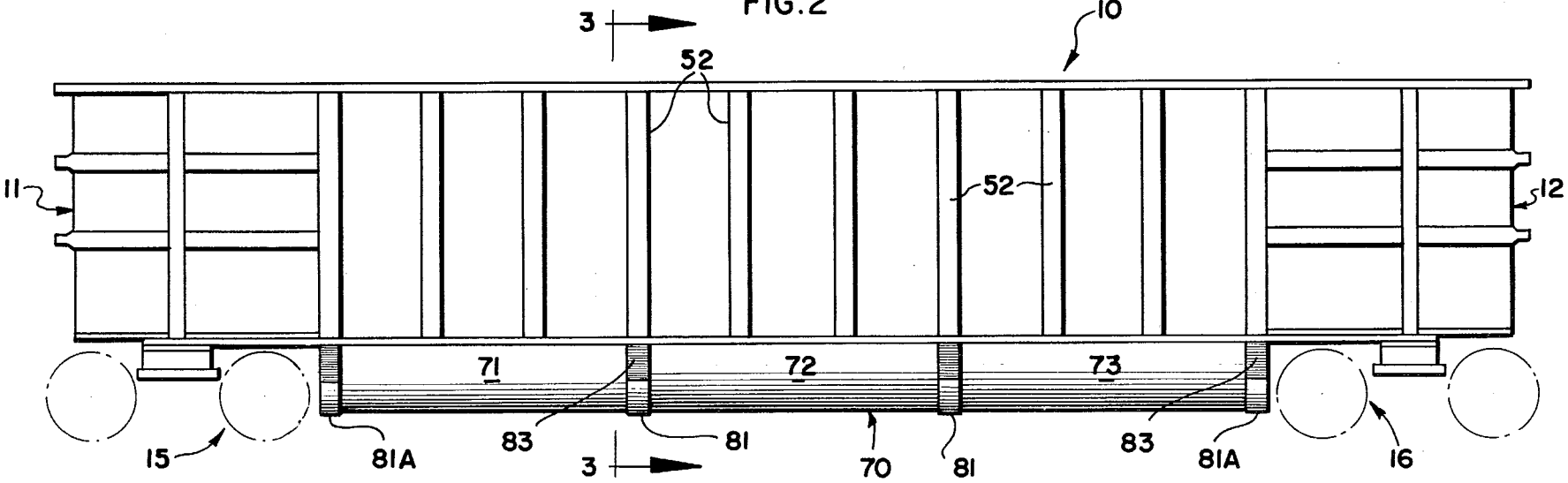
FIG. 2 is a side elevational view of the railway car shown in FIG. 1.

The gondola railway car 10 shown in FIGS. 1 and 2 has a pair of generally vertical end panels 11 and 12 and a pair of generally vertical side panels 13 and 14 joined to the end panels. Car trucks 15 and 16 at each end of the car are attached near the ends of the continuous center sill 20. The car bottom end portions 25 and 26 located over the car trucks 15 and 16 are essentially horizontal and flat and are joined to the bottom edge portions of the side and end panels.

The particular railway car shown in FIGS. 1 to 5 has four lateral horizontal spaced-apart cross bearers 30. Each cross bearer is made in two identical parts extending in opposite directions laterally from the center sill 20. Thus angle 31 extends out from one side of the center sill 20 and angle 32 extends out from the other side of the center sill. The outer end of the angles 31 and 32 are joined by welding to the inverted longitudinal channel members 50 and 60 constituting the bottom edges of side panels 13 and 14 respectively. Flat horizontal plate 35 extends laterally over the top of center sill 20 and the top of the inner end portions of angles 31 and 32. Cover plate 33 is placed on top of angle 31 and extends from one end of plate 35 to over the top of channel member 50. Similarly, cover plate 34 on angle 32 extends from the other end of plate 35 to cover the top of channel member 60. The sloped lower surfaces of angles 31 and 32 facilitate flow of coal and other granular materials from the car.

At the top of side panel 13 there is positioned an inverted channel member 51 which constitutes an upper chord of a side sill. Similarly, the inverted channel member 50 constitutes a lower chord of a side sill. Side posts 52 extend between the lower chord 50 and the upper chord 51. Vertical side wall 53 is joined at its top edge to upper chord 51 and at its lower edge to lower chord 50. The side wall 53 slopes outwardly as it extends upwardly to facilitate rotary discharge of lump and granular material from the car. The lower end of each diagonal brace 54 telescopes into a stub tube 55 joined to plate 35. Vertical gussets 57, 58 and 59 reinforce stub tube 55 as well as stub tube 65. The upper end of each brace 54 is joined to reinforcing plate 56 near the top of the wall. The other side of the railway car is similarly fabricated. Thus, the side panel 14 has an upper chord 61 made of an inverted channel member. Side posts 62 extend between the lower chord 60 and the upper chord 61 which together constitute a side sill. Outwardly sloped side wall 63 is joined at its upper edge to upper chord 61 and at its lower edge to lower chord 60. A diagonal brace 64 is located over each cross bearer angle 32. The lower end of each diagonal brace 64 is positioned in a stub tube 65 on plate 35 and reinforcing plate 66 is positioned at the upper end of each diagonal brace 64 at the top portion of side wall 63.

Located between the car trucks 15 and 16 is a pair of longitudinal troughs 70 and 90 which extend from the car flat bottom portions 25 and 26. The troughs 70 and 90 are identical mirror images of each other.

Figures 3, 4, 5:
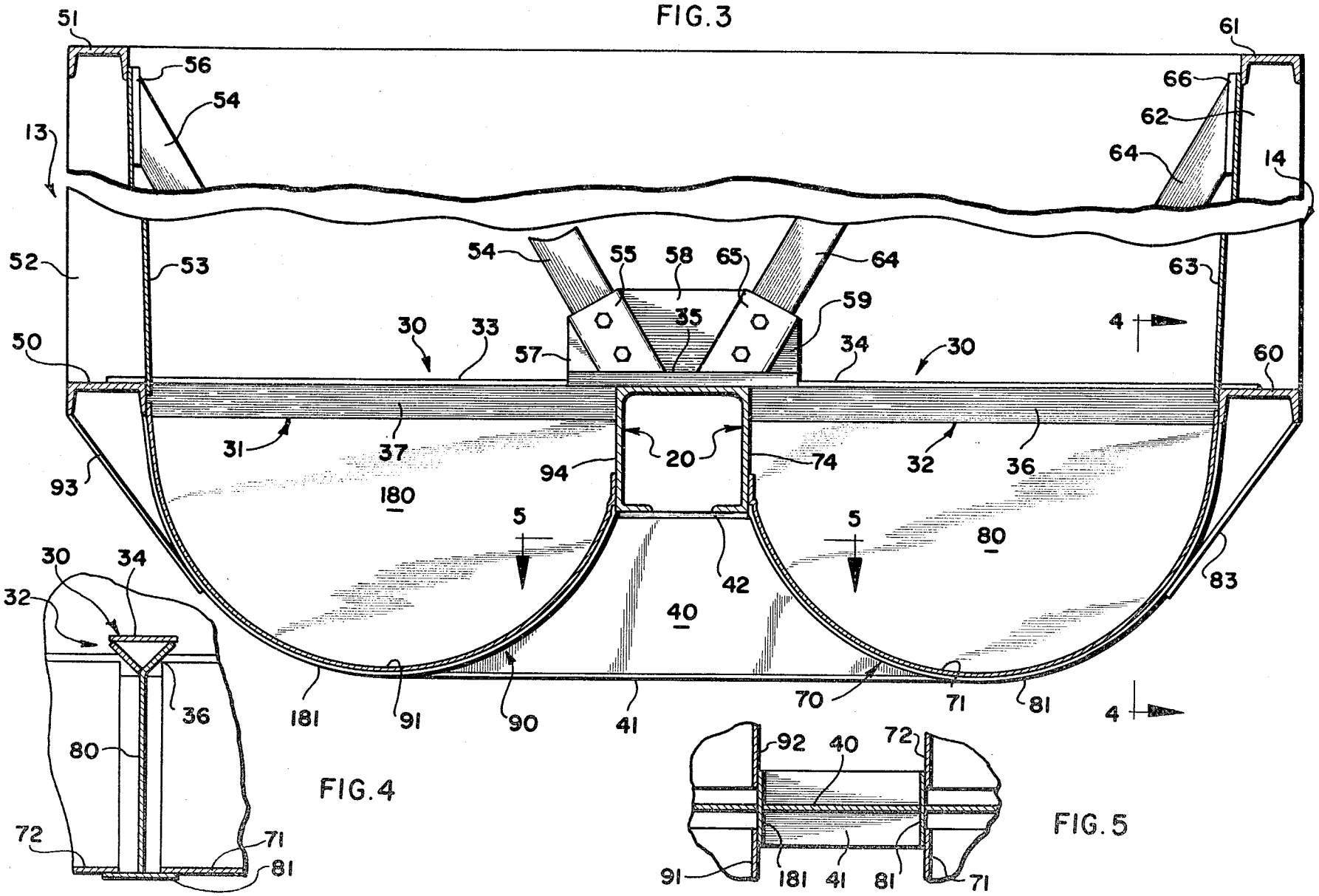
FIG. 3 is a sectional view taken along the line 3—3 of FIG. 2.
FIG. 4 is a sectional view taken along the line 4—4 of FIG. 3.
FIG. 5 is a sectional view taken along the line 5—5 of FIG. 3.

The trough 70 in cross section is substantially semi-circular and for convenience in fabrication is made of three separate sections 71, 72 and 73. The upper longitudinal side edges of each of the trough sections is welded to the inward vertical side of the lower chord 60 and to the side 74 of center sill 20. A vertical plate 80 extends downwardly from the lower edge of the angle member 32 of each cross bearer 30. As shown in FIG. 4, one side of angle member 32 constitutes a bent top portion 36 of plate 80. The lower edge of each of the vertical plates 80 is substantially semi-circular in shape and coincides with the semi-circular shape of each of the trough sections 71, 72 and 73. A metal strip 81 is welded to the lower edge of each vertical plate 80 located inward from the ends of trough 70. Each strip 81 extends outwardly from both sides of plate 80 and has its ends welded to the lower chord 60 and to the side 74 of center sill 20. These strips 81 provide support for the adjoining ends of the trough members 71–72, and 72–73 as illustrated by FIG. 4. Strips 81A on vertical trough end plates 80 at the ends of the trough 70 extend only inwardly rather than to both sides of plate 80 as shown for strip 81 in FIG. 4. Only an inward extension is required to receive the outer ends of trough sections 71 and 73. A series of braces 83 extend from the lower edge of lower chord 60 to the strips 81 and 81A to help support trough 70. The described structure divides the trough 70 into three lading compartments. The entire trough 70 is spaced below the top of the continuous center sill 20 thus lowering the car center of gravity.

The trough 90 in cross section is also semi-circular and for convenience in fabrication is made of three separate sections 91, 92 and 93. The upper longitudinal outer side edges of each of the trough sections is welded to the inward vertical side of the lower chord 50 and to the side 94 of center sill 20. A vertical plate 180 extends downwardly from the lower edge of the angle member 31 of each cross bearer 30. One side of angle member 31 constitutes a bent top portion 37 of plate 180. The lower edge of each of the vertical plates 180 is semi-circular in shape and coincides with the semi-circular shape of each of the trough sections 91, 92 and 93. A metal strip 181 is welded to the lower edge of each vertical plate 180 located inward from the ends of trough 90. Each strip 181 extends outwardly from both sides of plate 180 and has its ends welded to the lower chord 50 and to the side 94 of center sill 20. These strips 181 provide support for the adjoining ends of the trough members 91–92, and 92–93. Strips on vertical trough end plates 80 at the ends of the trough 90 extend only inwardly rather than to both sides of a plate 180. Only an inward extension is required to receive the outer ends of trough sections 91 and 93. A series of braces 93 extend from the lower edge of lower chord 50 to the strips 181 to help support trough 90. The described structure divides the trough 90 into three lading compartments. The entire trough 90 is spaced below the top of the continuous center sill 20 thus lowering the car center of gravity.

A vertically positioned plate or web 40 (FIGS. 3 and 5) is located beneath each cross bearer 30 between the strips 81 and 181. Plate 40 is reinforced with a horizontal flange 41 projecting laterally from both sides of the lower edge of plate 40 and extending to strips 81 and 181 to which it is joined. The plate 40 is joined to the bottom of the center sill 20 through strip 42 and to strips 81 and 181. The strip 42 is as wide as flange 41. Holes can be provided in each plate 40 to accommodate brake lines and other equipment associated with the braking system.

The double trough car as described in FIGS. 1 to 5 is designed to be light weight. It has increased carrying capacity equal to the volume of the troughs over that of a flat bottom gondola car. Furthermore, the space between the troughs beneath the center sill is ideal for positioning brake gear and related equipment.

Figures 6, 7, 8:
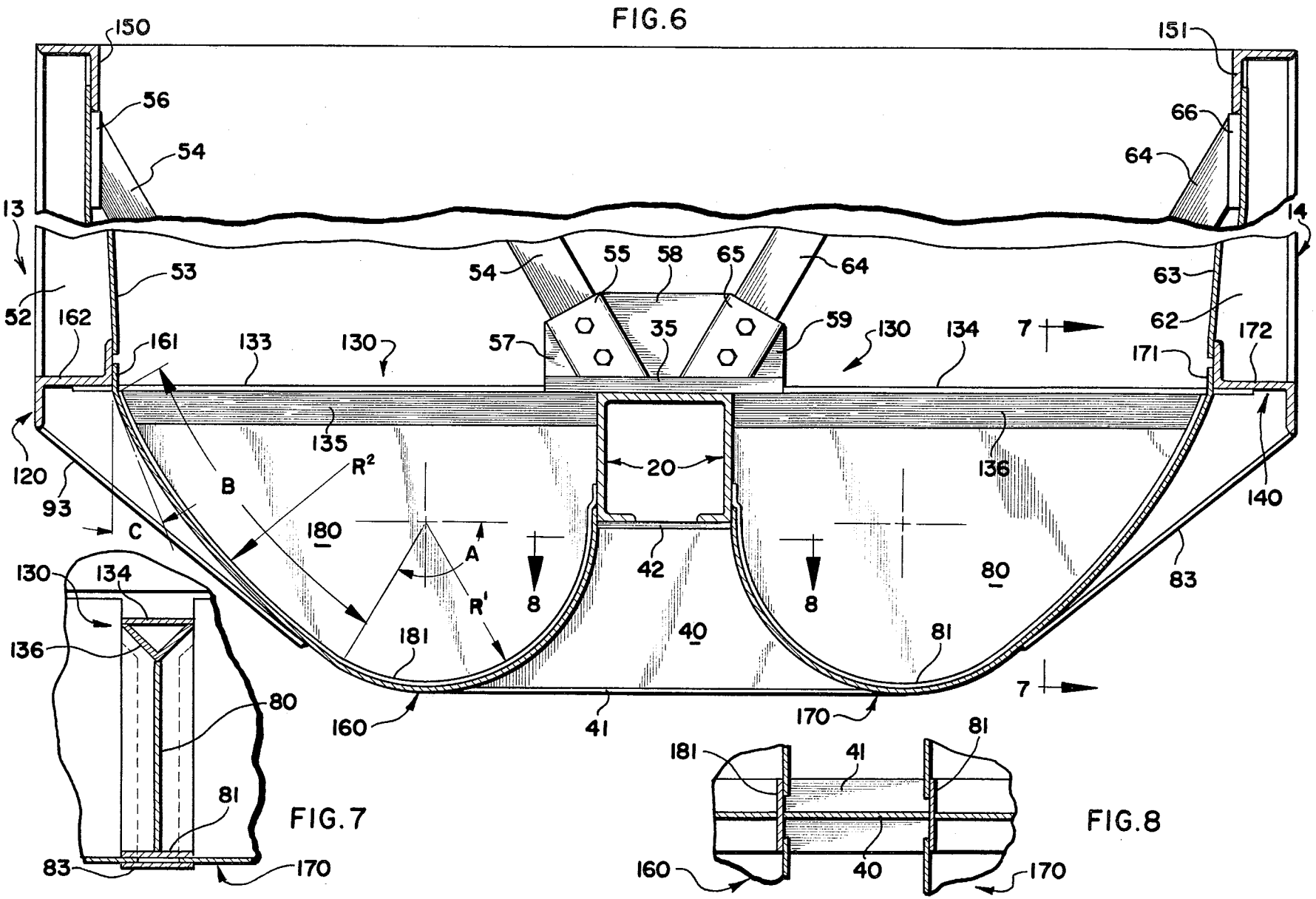
FIG. 6 is a sectional view, like FIG. 3, of another embodiment of the invention.
FIG. 7 is a sectional view taken along the line 7—7 of FIG. 6.
FIG. 8 is a sectional view taken along the line 8—8 of FIG. 6.

A second embodiment of the invention is shown in FIGS. 6 to 8. Many of the features of this embodiment are common to the embodiment shown in FIGS. 1 to 5. The differences in the second embodiment will therefore only be described. The four cross bearers 130 extend between the Zee-member chords 120 and 140 at each side of the car. Each cross bearer is triangularly shaped (FIG. 7) and is formed of cover plates 133 and 134 mounted on angle members 135 and 136 respectively. The outer ends of cover plates 133 and 134 are joined to the bottom of Zee-members 120 and 140 respectively.

At the top of side panels 13 and 14 there are positioned inverted angle members 150 and 151 instead of the inverted channels shown in FIG. 3.

The pair of troughs 160 and 170 (FIG. 6) are mirror images of each other and are similar to the pair of troughs 70 and 90 except that the troughs 160 and 170 are arced quite differently and the three sections making up each of the troughs 160 and 170 are joined at their ends to the outside of the strips 181 and 81 (FIGS. 7 and 8). The arc of each trough 160 and 170 is composed of two circular segments of different radius. The circular segment A shown in FIG. 6 has an angle of about 120° and a radius $R^1$ of about 15 inches while the circular segment B has a radius $R^2$ of about 70 inches. These two circular segments in combination form an arc shaped quite closely to a spiral.

The upper longitudinal side edges 161 and 171 of troughs 160 and 170 are welded respectively to the inward vertical upwardly directed flange of the Zee-member lower chords 120 and 140 adjacent the Zee-member web. The sections of each trough 160 and 170 are welded to the outside of metal strips 181 and 81 respectively (FIGS. 6 and 7), rather than on the inside as shown in FIGS. 3 and 4.

The use of a trough arced to a generally spiral shape as shown in FIG. 6 results in increased horizontal forces (compared to the troughs of FIG. 3 which have vertical side edges and a low horizontal force) exerted by the trough plates and directed inwardly towards the center sill when the car is loaded. These horizontal forces are very effectively opposed by the Zee-member lower chords 120 and 140 since the edges 161 and 171 of the troughs apply the inward forces right at the horizontal webs 162 and 172 of the Zee-members which can best oppose the loading forces without bending or rotating. The horizontal forces exerted by the arced trough plates of FIG. 6 reduce the internal bending moments of the lower chords 120 and 140 at the cross-bearer connections and in-between the cross bearers caused by the lateral loadings, such as water and granular material. If the ends 161 and 171 of the troughs were placed at the inner flange lower ends of channel chords 50 and 60 (FIG. 3) the horizontal loading forces would not be as effectively resisted. The use of the Zee-member also provides a horizontal web upper surface from which water and granular material can flow without obstruction. The Zee-member also provides the desired strength with light weight, an important factor in coal cars on long trips in unit trains.

To promote development of the horizontal forces each trough side which joins the side panel bottom edges should be joined at an angle C from the vetical (FIG. 6) which provides the desired force. Generally this angle should be about 30° from the vertical. Furthermore, to obtain suitable trough volume the inner side of each trough should be about vertical and desirably is joined to the vertical side wall of the center sill. Also, the trough when arced is desirably unsymmetrical and is deeper closer to the center sill than at the side panel bottom edge to which it is joined.

Figure 9:
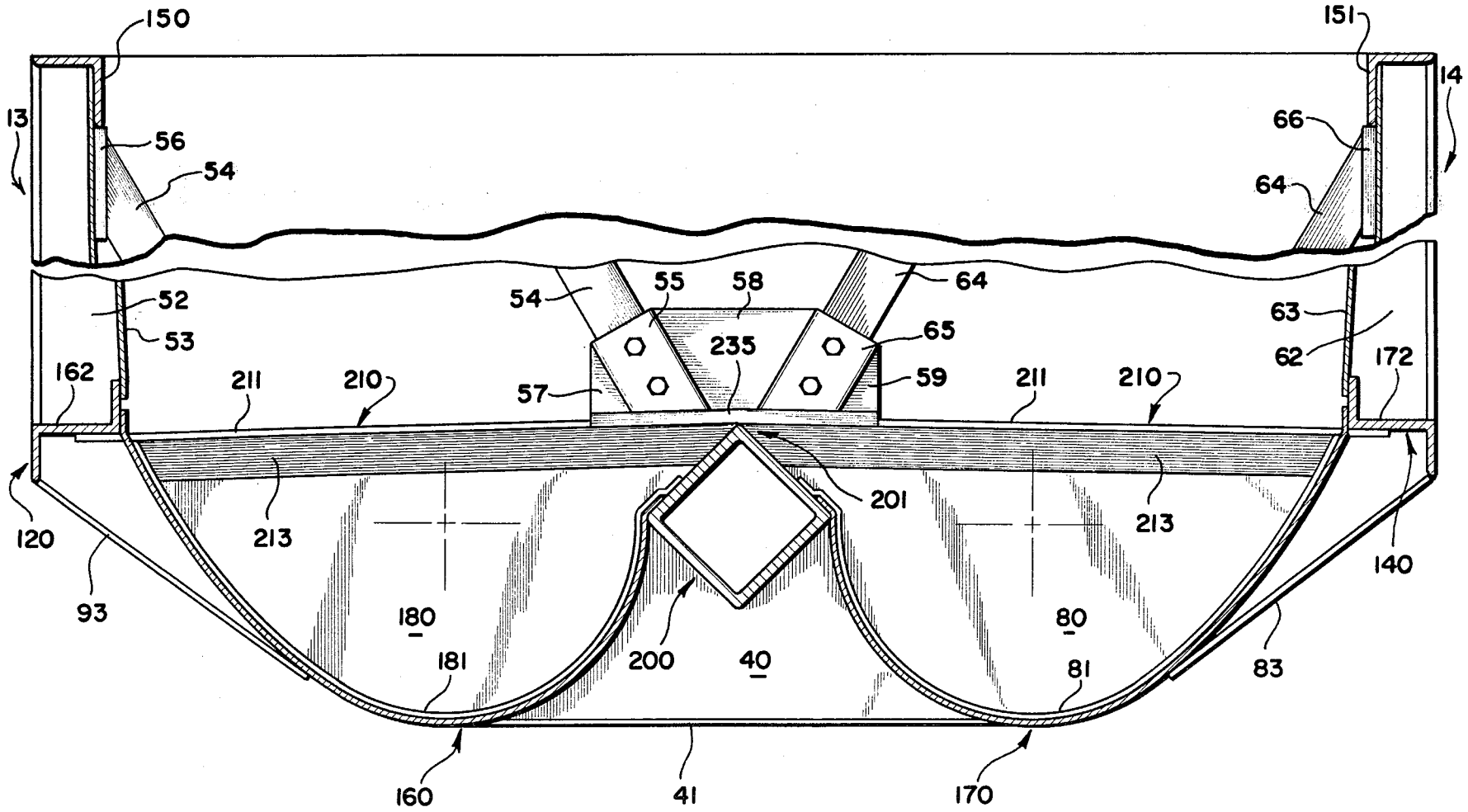
FIG. 9 is a sectional view, like FIG. 3, of a third embodiment of the invention.

A third embodiment of the invention is illustrated by FIG. 9. This embodiment is like the embodiment of FIG. 6 except for two differences. In the embodiment shown in FIG. 9 a square tube type center sill 200, generally like center sill 20, is rotated 45° from horizontal, to put one edge at top and the walls at 45°, to facilitate unloading granular material from the car by eliminating horizontal flat surfaces. Since the rotated center sill is desirably maintained in the center line of the draft the top edge 201 of the center sill is higher than the top of the center sill 20 (FIG. 6). Accordingly, to lower the center of gravity of the car the cross bearers 210 are sloped downwardly from the top edge 201 of the center sill. The cover plate 211 and the outwardly bent portion 213 (like bent portions 36 and 37) on vertical plates 80 and 180 slope downwardly. Plate 235, which spans the center sill on top of the cross bearers, has a downward slope from the center outwardly.

Figures 10, 11:
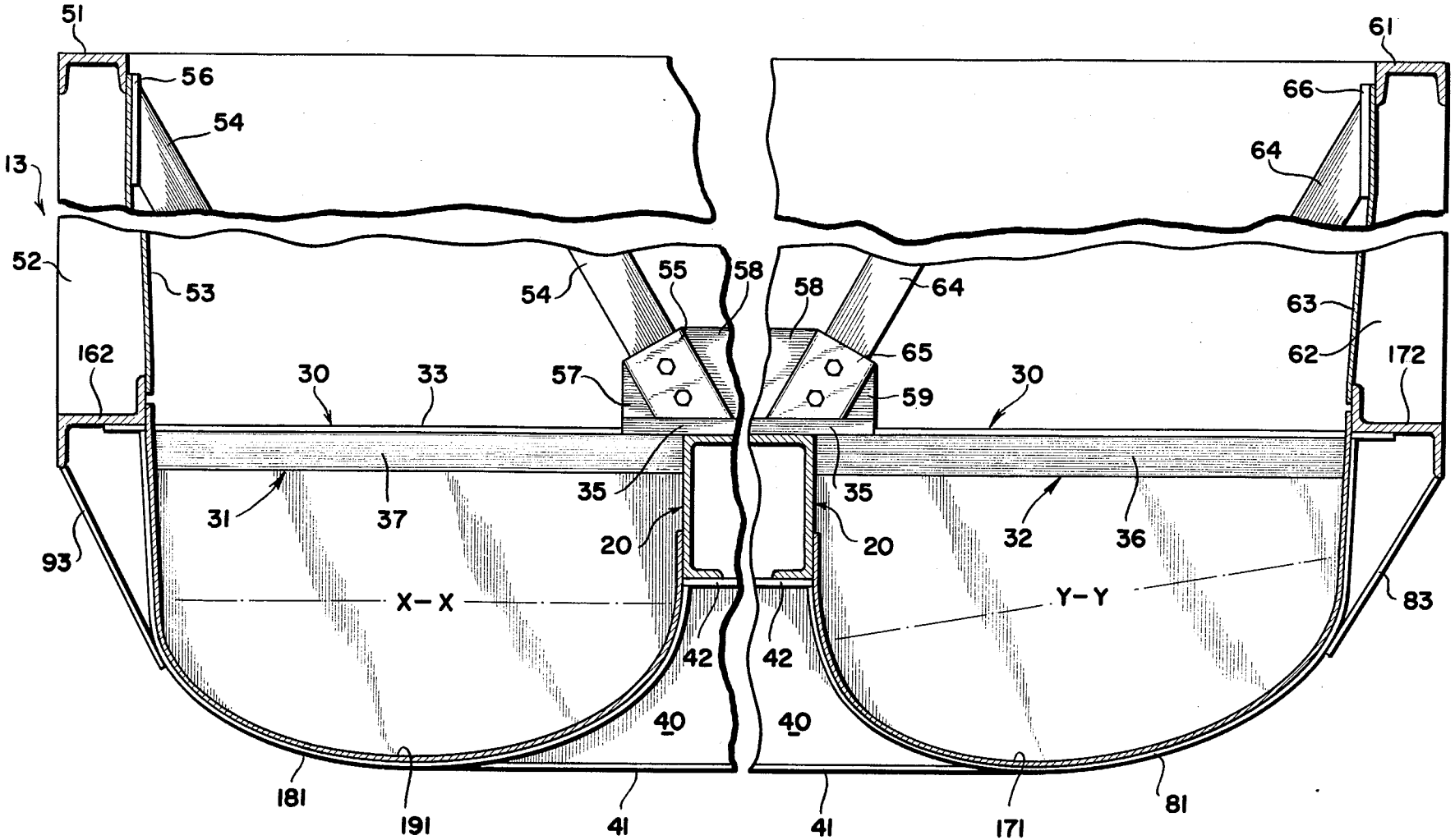
FIG. 10 is a sectional view, like part of FIG. 3, of a fourth embodiment of the invention.
FIG. 11 is a sectional view, like part of FIG. 3, of a fifth embodiment of the invention.

FIG. 10 illustrates a fourth embodiment of the invention in which the lower part of trough 191 is in the form of a semi-ellipse having its major axis X—X horizontal or parallel to the car floor.

FIG. 11 illustrates a fifth embodiment of the invention, similar to FIG. 10, in which the lower part of trough 171 is in the form of a semi-ellipse having its major axis Y—Y tilted with respect to the car floor to place the deepest part of the trough closer to the center sill.

By using semi-ellipse troughs as shown in FIGS. 10 and 11 a larger volume of product may be carried with a lower center of gravity than by using troughs which are semi-cylindrical.

The foregoing detailed description has been given for clearness of understanding only, and no unnecessary limitations should be understood therefrom as modifications will be obvious to those skilled in the art.

What is claimed is:

1. A gondola railway car comprising:

a car truck attached to each end of a continuous center sill, a pair of generally vertical end panels, a pair of generally vertical side panels joined to the end panels, a plurality of cross bearers extending from the center sill to a longitudinal chord at the bottom of each side panel, a car bottom between the end and side panels having substantially flat portions over the trucks and a pair of longitudinal trough portions between the trucks and extending below the flat bottom portions, a vertical plate joined to a cross bearer on each side of the center sill and extending downwardly terminating in a peripheral edge corresponding to the shape of the trough therebeneath, a strip joined to each vertical plate peripheral edge and extending laterally therefrom between the longitudinal chord at the bottom of the side panel and the center sill, the trough being in sections supported at the ends by such strips, each trough having a side edge joined to a side panel bottom edge and a side edge joined to the center sill, and an end wall at each end of each trough extending to the adjacent flat bottom portion.

2. A gondola railway car comprising:

a car truck attached to each end of a continuous center sill, a pair of generally vertical end panels, a pair of generally vertical side panels joined to the end panels, a plurality of cross bearers extending from the center sill to a longitudinal chord at the bottom of each side panel, the cross bearers being essentially triangular in lateral section and with the top surface thereof horizontal, a car bottom between the end and side panels having substantially flat portions over the trucks and a pair of longitudinal trough portions between the trucks and extending below the flat bottom portions, each trough portion having a side edge joined to a side panel bottom edge and a side edge joined to the center sill, and an end wall at each end of each trough extending to the adjacent flat bottom portion.

3. A gondola railway car according to claim 2 in which one of the sides of the cross bearers is the upper bent portion of a vertical plate extending downwardly to and joined to the trough surface over its width and depth.

4. A gondola railway car comprising:

a car truck attached to each end of a continuous center sill, a pair of generally vertical end panels, a pair of generally vertical side panels joined to the end panels, a plurality of cross bearers extending from the center sill to a longitudinal chord at the bottom of each side panel, a car bottom between the end and side panels having substantially flat portions over the trucks and a pair of longitudinal trough portions between the trucks and extending below the flat bottom portions, each trough portion having a side edge joined to a side panel bottom edge and a side edge joined to the center sill, an end wall at each end of each trough extending to the adjacent flat bottom portion, and the longitudinal chord at the bottom of each side panel being a Zee-member with the Zee-member web horizontal and the inner flange extending upwardly from the web to which the side panels are joined, and the trough side edges are joined to the inner flange adjacent the web.

5. A gondola railway car according to claim 4 in which the cross bearers have a horizontal plate on the top extending from the center sill to, and lapping with, the web of the Zee-member.

6. A gondola railway car according to claim 4 in which each trough is unsymmetrically arced in lateral section and is deeper closer to the center sill than at the side panel bottom edge to which it is joined.

7. A gondola railway car according to claim 6 in which the arc is substantially a spiral section.

8. A gondola railway car according to claim 6 in which each trough is joined to the side panel bottom edge at an acute angle from the vertical.

9. A gondola railway car according to claim 8 in which each trough is joined to the side of the center sill and the trough side so joined is about vertical at the center sill.

* * * * *